US007732387B2

(12) United States Patent
Varadaraj et al.

(10) Patent No.: US 7,732,387 B2
(45) **Date of Patent: *Jun. 8, 2010**

(54) PREPARATION OF AROMATIC POLYSULFONIC ACID COMPOSITIONS FROM LIGHT CAT CYCLE OIL

(75) Inventors: Ramesh Varadaraj, Flemington, NJ (US); Cornellus H. Brons, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1123 days.

This patent is subject to a terminal disclaimer.

(21) Appl. No.: 11/127,825

(22) Filed: May 12, 2005

(65) Prior Publication Data

US 2006/0183950 A1 Aug. 17, 2006

Related U.S. Application Data

(60) Provisional application No. 60/571,308, filed on May 14, 2004.

(51) Int. Cl.
*C10M 135/10* (2006.01)

(52) U.S. Cl. ..... 508/390; 562/33; 562/89; 562/90

(58) Field of Classification Search ..... 562/33, 562/89, 90; 508/390
See application file for complete search history.

(56) References Cited

U.S. PATENT DOCUMENTS

| | | | | |
|---|---|---|---|---|
| 2,626,207 | A | 1/1953 | Wies et al. | |
| 2,843,530 | A | 7/1958 | Langer, Jr., et al. | |
| 3,558,474 | A | 1/1971 | Gleim et al. | 208/108 |
| 3,617,514 | A | 11/1971 | Marlar | 208/131 |
| 3,684,697 | A | 8/1972 | Gamson | 208/131 |
| 3,707,459 | A | 12/1972 | Mason et al. | 208/76 |
| 3,769,200 | A | 10/1973 | Folkins | 208/53 |
| 3,852,047 | A | 12/1974 | Schlinger et al. | 44/24 |
| 4,140,623 | A | 2/1979 | Sooter et al. | 208/131 |
| 4,226,805 | A * | 10/1980 | Bauer | 562/33 |
| 4,298,455 | A | 11/1981 | Huang | 208/48 AA |
| 4,369,143 | A * | 1/1983 | Behre et al. | 562/90 |
| 4,390,474 | A * | 6/1983 | Nussbaum et al. | 562/33 |
| 4,399,024 | A | 8/1983 | Fukui et al. | 208/131 |
| 4,404,110 | A * | 9/1983 | Beazley et al. | 507/259 |
| 4,411,770 | A | 10/1983 | Chen et al. | 208/111 |
| 4,430,197 | A | 2/1984 | Poynor et al. | 208/56 |
| 4,440,625 | A | 4/1984 | Go et al. | 208/48 AA |
| 4,455,219 | A | 6/1984 | Janssen et al. | 208/131 |
| 4,478,729 | A | 10/1984 | Hunt et al. | |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,615,791 | A | 10/1986 | Choi et al. | |
| 4,616,308 | A | 10/1986 | Morshedi et al. | 364/159 |
| 4,619,756 | A | 10/1986 | Dickakian | |
| 4,659,453 | A | 4/1987 | Kukes et al. | |
| 4,659,543 | A | 4/1987 | Lui | 208/108 |
| 4,670,165 | A | 6/1987 | Black et al. | |
| 4,847,018 | A * | 7/1989 | Koepke et al. | 562/33 |
| 4,927,561 | A | 5/1990 | Forester | 252/389.22 |
| 4,966,679 | A | 10/1990 | Kubo et al. | |
| 5,110,981 | A * | 5/1992 | Milstein | 562/90 |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A | 3/1994 | Kriz et al. | |
| 5,322,556 | A * | 6/1994 | Prevedello et al. | 516/41 |
| 5,460,714 | A | 10/1995 | Fixari et al. | 208/112 |
| 5,645,711 | A | 7/1997 | Hraban et al. | 208/131 |
| 5,650,072 | A | 7/1997 | McClain et al. | |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,489,368 | B2 * | 12/2002 | Varadaraj et al. | 516/160 |
| 6,611,735 | B1 | 8/2003 | Henly et al. | 700/266 |
| 6,660,131 | B2 | 12/2003 | Lah | 202/245 |
| 7,335,790 | B2 * | 2/2008 | Domen et al. | 562/89 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 0031697 | 7/1981 |

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Ellen M McAvoy
(74) *Attorney, Agent, or Firm*—Bruce M. Bordelon

(57) ABSTRACT

A method for the preparation of a stream rich in aromatic polysulfonic acid compounds from light catalytic cycle oil. The preparation involves the polysulfonation of the light catalytic cycle oil using more than a stoichiometric amount of sulfuric acid. The aromatic polysulfonic acid compositions are preferably aromatic polynuclear compositions.

6 Claims, No Drawings

FOREIGN PATENT DOCUMENTS

| | | | |
|---|---|---|---|
| EP | 175511 | | 6/1988 |
| EP | 0839782 | A1 | 5/1998 |
| GB | 1218117 | | 1/1971 |
| WO | 95/14069 | | 5/1995 |
| WO | 99/64540 | | 12/1999 |
| WO | 03042330 | | 5/2003 |
| WO | 03048271 | | 6/2003 |
| WO | 2004/038316 | | 5/2004 |
| WO | 2004/104139 | | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, ELSEVIER Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

PREPARATION OF AROMATIC POLYSULFONIC ACID COMPOSITIONS FROM LIGHT CAT CYCLE OIL

CROSS-REFERENCE TO RELATED APPLICATION

This application claims benefit of U.S. Provisional Patent Application 60/571,308 filed May 14, 2004.

FIELD OF THE INVENTION

The present invention relates to a method for the preparation of a stream rich in aromatic polysulfonic acid compounds from light catalytic cycle oil. The preparation involves the polysulfonation of the light catalytic cycle oil using more than a stoichiometric amount of sulfuric acid. The aromatic polysulfonic acid compositions are preferably aromatic polynuclear compositions.

BACKGROUND OF THE INVENTION

Heavy oils are generally referred to those hydrocarbon comprising oils with high viscosity or API gravity less than about 20. Crude oils and crude oil residuum obtained after atmospheric or vacuum distillation of crude oils that exhibit an API gravity less than about 20 are examples of heavy oils. Upgrading of heavy oils is important in production, transportation and refining operations. An upgraded heavy oil typically will have a higher API gravity and lower viscosity compared to the heavy oil that is not subjected to upgrading. Lower viscosity will enable easier transportation of the oil. A commonly practiced method for heavy oil upgrading is thermal treatment of heavy oil. Thermal treatment includes processes such as visbreaking and hydro-visbreaking (visbreaking with hydrogen addition). The prior art in the area of thermal treatment or additive enhanced visbreaking of hydrocarbons teach methods for improving the quality, or reducing the viscosity, of crude oils, crude oil distillates or residuum by several different methods. For example, the use of additives such as the use of free radical initiators is taught in U.S. Pat. No. 4,298,455; the use of thiol compounds and aromatic hydrogen donors is taught in EP 175511; the use of free radical acceptors is taught in U.S. Pat. No. 3,707,459; and the use of a hydrogen donor solvent is taught in U.S. Pat. No. 4,592,830. Other art teaches the use of specific catalysts, such as low acidity zeolite catalysts (U.S. Pat. No. 4,411,770) and molybdenum catalysts, ammonium sulfide and water (U.S. Pat. No. 4,659,543). Other references teach upgrading of petroleum resids and heavy oils (Murray R. Gray, Marcel Dekker, 1994, pp. 239-243) and thermal decomposition of naphthenic acids (U.S. Pat. No. 5,820,750).

Generally, the process of thermal treatment of heavy oil can result in an upgraded oil with higher API. In some instances, the sulfur and naphthenic acid content can also be reduced. However, the main drawback of thermal treatment of heavy oils is that with increased conversion there is the formation of toluene insoluble (TI) material. These toluene insoluble materials comprise organic and organo-metallic materials derived from certain components of the heavy oil during the thermal process. Generally, the TI materials tend to increase exponentially after a threshold conversion. Thus, the formation of TI materials limits the effectiveness of thermal upgrading of heavy oils. Presence of TI material in upgrading oils is undesirable because such TI materials can cause fouling of storage, transportation and processing equipment. In addition, the TI materials can also induce incompatibility when blended with other crude oils. Increasing conversion without generating toluene insoluble material is a long-standing need in the area of thermal upgrading of heavy oils. The instant invention addresses this need. As used herein, crude oil residuum or resid refers to residual crude oil obtained from atmospheric or vacuum distillation of a crude oil.

SUMMARY OF THE INVENTION

In one embodiment, there is provided a method for the production of aromatic polysulfonic acids and salts of said acids compositions represented by the chemical structure:

$$R—Ar—(SO_3^-X^+)_n$$

where R is an alkyl group having from 0 to 3 carbon atoms, Ar is an aromatic ring structure comprised of from 1 to 3 aromatic rings, X is hydrogen or a metal selected those from Group I (alkali) and Group II (alkaline-earth) metals, and n is an integer from 1 to 5 when X is an alkali metal and 2 to 10 when X is an alkaline-earth metal, which method comprises:

reacting a light catalytic cycle oil with sulfuric acid in a an amount from about 1.2 to 2 times the stoichiometric amount at a temperature from about 20° C. to about 100° C. for an effective amount of time thereby forming a reaction product;

washing said reaction product with an organic solvent;

neutralizing the washed reaction product with a suitable base to form the corresponding polysulfonic acid salt.

In another embodiment, there is provided the polysulfonic acid salt prepared in accordance with the above method.

In a preferred embodiment the aromatic ring structure is a polynuclear ring structure comprised of 2 aromatic rings.

DETAILED DESCRIPTION OF THE INVENTION

The present invention relates to a process for the production of a stream rich in a mixture of aromatic polysulfonic acid compounds. The stream rich in the aromatic polysulfonic compounds is prepared by polysulfonating a light catalytic cycle oil (LCCO) with an excess amount of sulfuric acid. That is, with a greater that stoichiometric amount of sulfuric acid. This amount will preferably be about 1.2 to 2 times stoichiometric. The aromatic polysulfonic acid compounds, particularly in the salt form, can be separated from the LCCO stream and collected for sale or collected for use in another process in the refinery, such as a thermal conversion process for heavy oils. An alternative would be not to separate out the aromatic polysulfonic acid compounds, by to pass the entire LCCO stream rich in the aromatic polysulfonic acid compounds directly to a thermal conversion process unit. Such an alternative will be economically feasible because of the high concentration of 2-ring aromatics in an LCCO stream that will converted to aromatic polysulfonic acid compounds by the practice of the present invention.

Thermal conversion is used for upgrading heavy oils, such as crude oil as well as atmospheric and vacuum residuum. As long as at least an effective amount of the aromatic polysulfonic acid compounds are present in the product LCCO stream the stream can be added to the heavy oil before or during entry into the thermal reaction vessel. Thermal treatment of heavy oils is typically conducted at temperatures in the range of about 250° C. to 500° C. for about 30 second to 6 hours. The aromatic polysulfonic acid compound rich stream, or the separated aromatic polysulfonic acid compounds, are often referred to herein as an inhibitor additive.

As previously mentioned, the preferred inhibitor additive of the present invention is a polynuclear aromatic acid of the structures:

$$R—Ar—(SO_3^-X^+)_n$$

wherein R is an alkyl group containing 0 to 40, preferably about 0 to 10, and more preferably 0 to 5, and most preferably 0 carbon atoms, Ar is an aromatic group of at least 2 rings, X is hydrogen or a metal selected those from Group I (alkali) and Group II (alkaline-earth) metals, and n is an integer from 1 to 5 when X is an alkali metal and 2 to 10 when X is an alkaline-earth metal. Group I and Group II refer to the groups of the Periodic Table of Elements. Preferably X is selected from the alkali metals, more preferably sodium and potassium, most preferably sodium. It is also preferred that Ar have from about 2 to 15 rings, more preferably from about 2 to 4 rings, and most preferably from about 2 to 3 rings.

The aromatic rings can be fused or isolated aromatic rings. Further, the aromatic ring can be homo-nuclear or hetero-nuclear aromatic rings. By homo-nuclear aromatic ring is meant aromatic rings containing only carbon and hydrogen. By hetero-nuclear aromatic ring is meant aromatic rings that contain nitrogen, oxygen or sulfur in addition to carbon and hydrogen. R can be a linear or branched alkyl group. Mixtures of $R—Ar—(SO_3^-X^+)_n$ can be used. Light catalytic cycle oil is a complex combination of hydrocarbons produced by the distillation of products from the fluidized catalytic cracking (FCC) process with carbon numbers in the range of about $C_9$ to about $C_{25}$, boiling in the approximate range of 340° F. (171° C.) to 700° F. (371° C.). Light catalytic cycle oil is also referred to herein as light cat cycle oil and LCCO. LCCO is generally rich in 2-ring aromatic molecules. LCCO from US refineries typically comprises about 80% aromatics. The aromatics are typically 33% 1-ring aromatics and 66% 2-ring aromatics. Further, the 1- and 2-ring aromatics can be methyl, ethyl and propyl substituted. The methyl group is the major substituent. Nitrogen and sulfur containing heterocycles, such as indenes are also present in minor quantities.

The polysulfonic acid compounds are produced from LCCO by a process that generally includes the polysulfonation of the LCCO with a stoichiometric excess of sulfuric acid at effective conditions. Conventional sulfonation of petroleum feedstocks typically use an excess of the petroleum feedstock—not an excess of sulfuric acid. It has unexpectedly been found by the inventors hereof that when a stoichiometric excess of sulfuric acid is used to sulfonate an LCCO the resulting polysulfonated product has novel properties and uses. The aromatic polysulfonic acid is converted to the aromatic polysulfonic acid salt by treatment with an amount of caustic to neutralize the acid functionality. The LCCO polysulfonic acid composition can best be described as a mixture of 1- and 2-ring aromatic cores with 1 or more sulfonic acid groups per aromatic core. The aromatic cores are preferably methyl, ethyl, and propyl substituted, with the methyl group being the more preferred substituent.

Typically, the amount of inhibitor additive added can be about 10 to about 50,000 wppm, preferably about 20 to 3000 wppm, and more preferably 20 to 1000 wppm based on the amount of crude oil or crude oil residuum. The inhibitor additive, if separated from the LCCO product stream, can be added as is or in a suitable carrier solvent. Preferred carrier solvents are aromatic hydrocarbon solvents such as toluene, xylene, crude oil derived aromatic distillates such as Aromatic 150 sold by ExxonMobil Chemical Company, water, alcohols and mixtures thereof. When the inhibitor additive is a salt it is preferred to use water or water-alcohol mixtures as the carrier solvent. Preferred alcohols are methanol, ethanol, propanol and mixtures thereof. When mixtures of the acid form and the acid salts are used, it is preferred to use an emulsion of water and hydrocarbon solvents as the carrier medium. The emulsion can be a water-in-oil emulsion or an oil-in-water emulsion. The carrier solvent is preferably 10 to 80 weight percent of the mixture of additive and carrier solvent.

Contacting the inhibitor additive, or LCCO-additive product stream containing the inhibitor additive, with the heavy oil can be achieved at any time prior to the thermal treatment. Contacting can occur at the point where the heavy oil is produced at the reservoir, during transportation or at a refinery location. In the case of crude oil resids, the inhibitor additive is contacted at any time prior to thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of 90° C. to 150° C. After contacting and mixing the heavy oil and additive, the mixture can be cooled from about contacting temperature to about ambient temperature i.e., about 15° C. to 30° C. Further, the additized-cooled mixture can be stored or transported from one location to another location prior to thermal treatment. Alternately, the additized and cooled mixture can be thermally treated at the location of contacting if so desired.

Thermal treatment of the additized heavy oil comprises heating the oil at temperatures in the range of about 250° C. to 500° C. for about 30 seconds to 6 hours. Process equipment such as visbreakers and delayed coker furnaces can be advantageously employed to conduct the thermal treatment. It is preferred to mix the additized heavy oil during thermal treatment using mixing means known to those having ordinary skill in the art. It is also preferred to conduct the thermal treatment process in an inert environment. Using inert gases such as nitrogen or argon gas in the reactor vessel can provide such an inert environment.

The inhibitor enhanced thermal upgrading process provides a thermally upgraded product that is higher in API gravity compared to the starting feed and lower in toluene insoluble material compared to a thermally upgraded product that is produced in the absence of the inhibitor additive of the instant invention. The inhibitor additive of the instant invention inhibits the formation of toluene insoluble material while facilitating thermal conversion, such as thermal cracking, to occur in a facile manner. The thermally upgraded product of the process of the instant invention has at least 20% less toluene insoluble material compared to the product from a thermally upgraded process conducted at the same temperature for the same period of time, but in the absence of the inhibitor additive. The thermally upgraded product of the process of the instant invention has at least 15 API units higher compared to the product from a thermally upgraded process conducted at the same temperature for the same period of time, but in the absence of the inhibitor additive. The upgraded oil of the instant invention comprises the upgraded heavy oil, the added inhibitor additive and products, if any, formed from the added inhibitor additive during the thermal upgrading process.

When the upgrading is conducted in a pre-refinery location, it is customary to mix the upgraded oil with other produced but not thermally treated crude oils prior to transportation and sale. The other produced but not thermally treated crude oils, can be the same heavy oil from which the upgraded oil is obtained or different crude oils. The other produced but not thermally treated crude oils can be dewatered and or desalted crude oils. By "non-thermally treated" is generally meant not thermally treated at temperatures in the range of about 250° C. to 500° C. for about 30 seconds to 6 hours. A particular advantage of the upgraded oil of the instant invention is that the presence of a relatively low amount of toluene insoluble (TI) material enables blending of the upgraded oil and other oils in a compatible manner. The mixture of upgraded oil of the instant invention with other compatible oils is a novel and valuable product of commerce. Another feature of the upgraded oil product of the instant invention is that the product can also be mixed with distillates or resids of other crude oils in a compatible manner. The low TI levels in the product enables this mixing or blending.

Thermal Upgrading with Hydrogen and Bifunctional Additive

According to another embodiment of the invention, there is provided a thermal treatment method for upgrading heavy crude oils and crude oil residuum including hydrogen. A bifunctional additive that provides the dual functionality of TI inhibition and catalysis of hydrogenation reactions is added to the crude or crude oil residuum followed by thermal treatment. The thermal treatment comprises treating the bifunctional additized oil at a temperature in the range of about 250° C. to 500° C. in the presence of hydrogen at hydrogen partial pressures of between 500 to 2500 psig (3447.38 to 17236.89 kPa) for a time between 0.1 to 10 hours to result in an upgraded oil.

Examples of bifunctional additives suitable for thermal treatment method, including hydrogen for upgrading of heavy oils, are LCCO-aromatic polysulfonic acid and LCCO-alkyl aromatic polysulfonic acid salts of the metals of Group IV-B, V-B, VI-B, VII-B and VIII of the Periodic Table of Elements. The bifunctional additive is represented by the chemical structure:

$$[R—Ar—(X)_n]_a M_b$$

wherein Ar is an aromatic group containing 2 to 15 aromatic rings; X is a sulfonic acid functionality, n is an integer from 1 to 15 representing the number of sulfonic acid functionality on the Ar hydrocarbon; R is an alkyl group containing from 0 to 40 carbon atoms; M is an element selected from the group consisting of Group IV-B, V-B, VI-B, VII-B and VIII of the Long Form of The Periodic Table of Elements; and a and b are integers each ranging from 1 to 4. The R group can be a linear or branched alkyl group. The aromatic rings can be fused or isolated aromatic rings. Further, the aromatic rings can be homo-nuclear or hetero-nuclear aromatic rings. By homo-nuclear aromatic rings is meant aromatic rings containing only carbon and hydrogen. By hetero-nuclear aromatic ring is meant aromatic rings that contain nitrogen, oxygen and sulfur in addition to carbon and hydrogen.

When the metal component of the bifunctional additive is a Group IV-B metal it may be titanium (Ti), zirconium (Zr), or hafnium (Hf). When the metal is a Group V-B metal it may be vanadium (V), niobium (Nb), or tantalum (Ta). When the metal is a Group VI-B metal it may be chromium (Cr), molybdenum (Mo), or tungsten (W). When the metal is a Group VII-B metal it can be manganese (Mn) or rhenium (Re). When the metal is a Group VIII metal it may be a non-noble metal such as iron (Fe), cobalt (Co), or nickel (ni) or a noble metal such as ruthenium (Ru), rhodium (Rh), palladium (Pd), osmium (Os), iridium (Ir), or platinum (Pt). Preferably, the metal is a Group VI-B metal, most preferably molybdenum.

The bifunctional additives of the instant invention, by virtue of their molecular structure and their being a component of the LCCO, exhibit favorable compatibility with asphaltene-rich heavy oils. The bifunctional additives may also be activated under the conditions of the hydroconversion process.

The impact of the bifunctional additive may be augmented by use of mixtures of bifunctional additives of more than one metal. For example, if molybdenum is used, it is desirable to add an additional quantity of cobalt. This is anticipated to yield a positive synergistic effect on catalytic hydrogenation process. Typically, cobalt may be added in an amount from about 0.2 to about 2 mols, preferably about 0.4 mols per mol of molybdenum.

The bifunctional additive part of the LCCO can be present in an amount ranging from 1 to 300 wppm metal. More preferably in the range of about 1 to about 60 wppm of metal based on hydrocarbon oil to be hydroconverted. It is preferred to mix the heavy oil and additive during the thermal treatment upgrading process. Mixing means and process equipment known to one having ordinary skill in the art can be used. Process equipment operable at high pressure, such as high pressure visbreakers, can be advantageously used to conduct the thermal treatment process in the presence of hydrogen.

The bifunctional additive can be contacted with the heavy oil as is or with use of a carrier solvent. Preferred carrier solvents include aromatic hydrocarbon solvents such as toluene, xylene, crude oil derived aromatic distillates such as Aromatic 150 sold by ExxonMobil Chemical Company, water, alcohols and mixtures thereof. Preferred alcohols are methanol, ethanol, propanol and mixtures thereof. The carrier solvent can range from 10 to 80 weight percent of bifunctional additive and carrier solvent.

Contacting the heavy oil with the bifunctional additive can be achieved at any time prior to thermal treatment. Contacting can occur at the point where the heavy oil is produced at the reservoir, during transportation, or at a refinery location. In the case of crude oil resids, the bifunctional additive is contacted at any time prior to the thermal treatment. After contacting, it is preferred to mix the heavy oil and additive. Any suitable mixing means conventionally known in the art can be used. Non-limiting examples of such suitable mixers include in-line static mixers and paddle mixers. The contacting of the heavy oil and additive can be conducted at any temperature in the range of about 10° C. to 90° C. for an effective amount of time. After contacting and mixing the mixture of heavy oil and additive the mixture can be cooled from about contacting temperature to about ambient temperature i.e., about 15° to about 30° C. Further, the additized-cooled mixture can be stored or transported from one location to another location prior to thermal treatment. Alternately, the additized and cooled mixture can be thermally treated at the location of contacting if so desired. Thermal treatment of the bifunctional additized heavy oil comprises heating said additized heavy oil at a temperature in the range of about 250° C. to about 500° C. in the presence of hydrogen at hydrogen partial pressure of between about 500 to about 2500 psig (3447.38 to 17236.89 kPa), for a time between about 0.1 to about 10 hours to result in an upgraded oil product.

The bifunctional additive enhanced hydrotreating upgrading process of the present invention provides an upgraded product that is higher in API gravity compared to the starting feed and lower in toluene insoluble material compared to a hydrotreated upgraded product that is produced in the absence of the bifunctional additive of the instant invention. By virtue of the inhibitor function of the bifunctional additive, the formation of toluene insoluble material is inhibited while facilitating hydroconversion to occur in a facile manner. The upgraded product of the thermal treatment process in the presence of hydrogen has at least 20% less toluene insoluble material compared to the product from a thermal treatment process conducted at the same temperature for the same period of time but in the absence of the bifunctional inhibitor-hydrotreating additive. The upgraded oil of the instant invention comprises the upgraded heavy oil, the added bifunctional additive and products formed from the added bifunctional additive during the thermal upgrading process.

EXAMPLE

The following example is included herein for illustrative purposes and are not meant to be limiting.

Polysulfonation of LCCO

To 25 g of LCCO was added 25 g of concentrated sulfuric acid and the mixture heated to 70° C. and maintained at 70° C. with mixing for 2 days. After completion of reaction the product was washed with 100 ml of toluene in three aliquots and dried at 85° C. to provide the LCCO polysulfonic acid product. The acid product was neutralized with caustic to provide the corresponding polysodium salt. It is to be noted that excess concentrated sulfuric acid was used, departing from prior art sulfonation methods, to achieve polysulfonation of the LCCO.

Product Characterization (LCCO polysulfonic Acid)

FTIR and $^{13}$C-NMR were used to characterize LCCO polysulfonic acid. FTIR of the product and the results showed distinct sulfonic acid stretching and bending vibration modes corresponding to hydrated sulfonic acid i.e., $R—SO_3^-H_3O^+$. The FTIR spectra resemble sulfonate salts. Sulfonate salts have bands near ~1230-1120 $cm^{-1}$ and ~1080-1025 $cm^{-1}$ (asymmetric and symmetric $SO_2$ stretches). $H_3O^+$ gives rise to features near ~2800-1650 $cm^{-1}$ (broad) and near 2600, 2250, and 1680 $cm^{-1}$. The "free OH" bands observed near 3520 $cm^{-1}$ (doublet) confirm the presence of significant water of hydration—sufficient to form the hydronium ion. This indicates that the product is predominantly hydrated sulfonic acid in the hydronium sulfonate form.

$^{13}$C-NMR of the product showed distinct Aromatic Carbon-$SO_3H$ resonances at 141.72 ppm and 181 ppm.

Aqueous LCCO-sulfonic acid product was titrated with NaOH. 5 g of product were diluted with 5 g of distilled water to produce a 50% active material. This 50% active material was used for the NaOH titration. From titration, for 1 gram of 50% active material, 0.143 g of NaOH was required for complete neutralization. Expressed on a per gram actives basis, 1 gram of the sulfonated product required 0.286 g of NaOH.

Surface Activity of LCCO polysulfonic Acid polysodium Salt

The air/water and oil/water surface tensions for the LCCO polysulfonic acid polysodium salt were determined by the Wilhelmy plate and pendant drop methods known to one of ordinary skill in the art of surface science. Table 1 and Table 2 list the observed values of air/water and oil/water surface tensions respectively for the LCCO polysulfonic acid sodium salt. (LCCO-PSS). We observe values similar to that observed for 1,3,6-naphthalene trisulfonic acid tri sodium salt. (1,3,6-NTSS) and the 1,3,6,8-pyrene tetra sulfonic acid sodium salt (1,3,6,8-PTSS). This data indicates high surface activity or surfactancy of the LCCO polysulfonic acid sodium salt. The presence of methyl, ethyl and propyl substituents on the 1- and 2-ring aromatic cores of the LCCO product do not alter the surface activity significantly.

TABLE 1

| Additive | Air/Water Surface Tension (dynes/cm) {+/−0.5} |
|---|---|
| None | 72 |
| 2-NSS | 43 |
| 2,6-NDSS | 23 |
| 1,3,6-NTSS | 21 |
| 1,3,6,8-PTSS | 21 |
| LCCO-PSS | 21 |

TABLE 2

| Additive | Oil/Water Interfacial Tension (dynes/cm) {+/−0.5} |
|---|---|
| None | 45.5 |
| 2,6-NDSS | 19.3 |
| 1,3,6-NTSS | 3.2 |
| 1,3,6,8-PTSS | 1.5 |
| LCCO-PSS | 1.5 |

The above data demonstrates that LCCO can be converted to aromatic polysulfonate salts that are water soluble and possess unexpectedly high surface activity.

The invention claimed is:

1. A method for upgrading a heavy oil comprising the steps of:

adding to said heavy oil an amount of light catalytic cycle oil containing an effective amount of polynuclear aromatic acid represented by the formula:

$$R—Ar—(SO_3^-X^+)_n$$

where R is an alkyl group having from 0 to 40 carbon atoms, Ar is an aromatic ring structure comprised of from 2 to 15 aromatic rings, X is an alkali or alkaline-earth metal, and n is an integer from 1 to 5 when X is an alkali metal and 2 to 10 when X is an alkaline-earth meal; and thermally treating said additized heavy oil at a temperature in the range of about 250° C. to 500° C. for 0.5 to 6 hours to upgrade the heavy oil;

wherein the polynuclear aromatic acid is produced from the light catalytic cycle oil by a process that includes the polysulfonation of the light catalytic cycle oil with a stoichiometric excess of sulfuric acid at effective conditions.

2. The method of claim 1 wherein the heavy oil is selected from the group consisting of crude oil, vacuum resids and atmospheric resids.

3. The method of claim 1 wherein the effective amount of additive is from about 10 to about 50,000 wppm based on the weight of heavy oil.

4. The method of claim 3 wherein the effective amount of additive is from about 20 to 3,000 wppm.

5. The method of claim 1 wherein the polynuclear aromatic acid is comprised of 2 to 15 aromatic rings.

6. The method of claim 5 wherein the polynuclear aromatic acid contains 2 to 6 aromatic rings.

* * * * *